US006260221B1

(12) United States Patent
Grabell et al.

(10) Patent No.: US 6,260,221 B1
(45) Date of Patent: Jul. 17, 2001

(54) MEDICAL APPARATUS FOR THE TREATMENT AND PREVENTION OF HEEL DECUBITUS

(76) Inventors: Marc Grabell, 485 Blue Ash Dr.; Lawrence E. Gluskin, 623 Raintree Rd., both of Buffalo Grove, IL (US) 60089; Barbara Simms, 19W 645 Fourteenth St., Lombard, IL (US) 60148

( * ) Notice: Subject to any disclaimer, the term of this patent is extended or adjusted under 35 U.S.C. 154(b) by 0 days.

(21) Appl. No.: 09/374,410

(22) Filed: Aug. 13, 1999

(51) Int. Cl.[7] ..... A47C 17/86

(52) U.S. Cl. ..... 5/648; 5/651; 5/655.5; 128/882

(58) Field of Search ..... 5/648, 649, 650, 5/651, 624, 734, 655.5, 655.3, 909, 925; 297/423.17, 423.19, 423.26; 128/882

(56) References Cited

U.S. PATENT DOCUMENTS

| | | | | |
|---|---|---|---|---|
| 3,162,486 | * | 12/1964 | Emery | 5/648 X |
| 3,308,491 | * | 3/1967 | Spence | 5/909 |
| 3,639,927 | * | 2/1972 | Munch | 5/648 X |
| 3,803,645 | * | 4/1974 | Oliverius | 5/650 |
| 4,135,504 | * | 1/1979 | Spann | 128/882 X |
| 4,185,813 | * | 1/1980 | Spann | 5/648 |
| 4,266,298 | * | 5/1981 | Graziano | 128/882 X |
| 4,471,538 | * | 9/1984 | Pomeranz et al. | 5/909 |
| 5,134,739 | * | 8/1992 | Gaffe et al. | 5/648 |
| 5,449,339 | * | 9/1995 | Drennan | 128/882 X |
| 5,454,993 | * | 10/1995 | Kostich | 264/46.4 |
| 5,603,336 | * | 2/1997 | Shepich | 128/882 |
| 5,636,395 | * | 6/1997 | Serda | 5/655.5 X |
| 5,737,788 | * | 4/1998 | Castellino et al. | 5/655.5 |
| 5,742,963 | * | 4/1998 | Trevino et al. | 5/632 |
| 5,745,939 | * | 5/1998 | Flick et al. | 5/648 |
| 5,790,998 | * | 8/1998 | Crescimbeni | 5/648 |
| 5,809,595 | * | 9/1998 | Stevens et al. | 5/925 |

FOREIGN PATENT DOCUMENTS

| | | | | |
|---|---|---|---|---|
| 2238470 | * | 6/1991 | (GB) | 5/648 |

OTHER PUBLICATIONS

Heelbo, Inc. brochure.
Bio Clinic brochure.

* cited by examiner

*Primary Examiner*—Michael F. Trettel
*Assistant Examiner*—James M Hewitt
(74) *Attorney, Agent, or Firm*—Leydig, Voit & Mayer Ltd

(57) ABSTRACT

A heel supporting medical apparatus for the treatment and prevention of decubitus or pressure ulcers. The present invention provides a medical and physical therapy apparatus adapted to elevate heels of individuals subjected to substantial bed rest. By elevating the heels, the skin of the heel will not be in constant contact with the bed mattress, and thus pressure ulcers or bedsores will be substantially avoided. Moreover, the present invention provides an apparatus by which the legs of the individual can be substantially immobilized while at the same time elevating the heel. The apparatus also provides adjustably cushioned support from several angles to increase the comfort of the individual.

7 Claims, 5 Drawing Sheets

MEDICAL APPARATUS FOR THE TREATMENT AND PREVENTION OF HEEL DECUBITUS

FIELD OF THE INVENTION

The present invention generally relates to medical and physical therapy apparatus, and more particularly relates to the apparatus for the treatment and prevention of decubitus, or pressure ulcers, specifically on the heel of the foot.

BACKGROUND OF THE INVENTION

When individuals are injured, ill, or otherwise infirm, they are often subjected to relatively long periods of rest wherein the body maintains the substantially same position for relatively long periods of time. For example, if the individual is injured and confined to bed rest, the body will rest on the bed or mattress in the relatively same position and be supported by discreet portions of the body, including the heel of each foot. As a result of this sedentary position, the heels will continually rub against the bed or mattress and result in a pressure ulcer, sometimes referred to as a bedsore, or decubitus. If left untreated, such decubitus can present a serious health concern and subject the individual to substantial pain and discomfort.

As a result of the foregoing, a number of mechanisms and methods have been developed to limit the formation of such decubitus. If the patient is mobile or sufficiently healthy to allow it, he or she will be required to move about to a sufficient degree to avoid such formation. Alternatively, pillows or other impromptu elevation devices can be used to elevate the heel away from the mattress. In addition, still further devices, such as foam cushions, can be wrapped around the leg or placed below the leg to elevate the heel.

While such devices can temporarily elevate the heel, they often provide insufficient structure to prevent movement of the legs or contact of the heel with the mattress. For example, it is sometimes necessary for the legs of the individual to be immobilized in addition to being elevated. Moreover, the elevation and immobilization should advantageously be provided while still enabling the patient to reach a satisfactory level of comfort and to allow the apparatus to be readily cleaned and reused. Heretofore, no such apparatus has been provided.

SUMMARY OF THE INVENTION

It is therefore an objective of the present invention to provide a heel supporting medical apparatus adapted to elevate the heels of an individual to avoid formation of decubitus.

It is another objective of the present invention to provide a heel supporting medical apparatus which not only elevates the heel of the individual, but substantially immobilizes the legs if necessary.

It is yet another objective of the present invention to provide such a heel supporting medical apparatus which provides the patient with an increased level of comfort.

It is another objective of the present invention to provide a heel supporting medical apparatus which is adapted to operate in at least two modes, one for the prevention of decubitus formation, and another mode for treatment of individuals once pressure ulcers have formed.

In accordance with these objectives, it is a feature of a preferred embodiment of the present invention to provide a heel protection device for treating and preventing formation of pressure ulcers on and having a base adapted to rest on a mattress or bed, a plurality of cushioned supports attached to the base and adapted to support the leg from various angles while supporting the heel, and having a cushioned heel support positioned directly below the elevated heel.

It is another feature of the preferred embodiment of the present invention to provide the aforementioned supports in the form of air cushions or mattresses which are able to be inflated and deflated through compressed air.

It is yet another feature of a preferred embodiment of the present invention to provide a foldable bottom and two foldable sides which can be folded to be perpendicular to the center of the base to substantially surround the legs and, in cooperation with the air mattresses or cushions being inflated, secure or immobilize the legs while at the same time elevating the heels.

In accordance with these objectives and features, a preferred embodiment of the present invention is provided in the form of a heel protection device for treating and preventing formation of pressure ulcers and comprises a base, a first support on the base in order to support and elevate human legs from the knees to the ankles, a second support on the base proximate the second end and spaced from the first support, third and fourth supports proximate the first and second sides respectively, and a cushioned heel support on the base between the first and second supports and between the third and fourth supports. The base includes first and second ends defining a longitudinal axis, and first and second sides defining a lateral axis. The second support is adapted to limit longitudinal movement of the feet, while the third and fourth supports are adapted to limit lateral and rotation movement of the legs.

These and other objectives and features of the invention will become more apparent from the following detailed description when taken in conjunction with the accompanying drawings.

Figure 1:
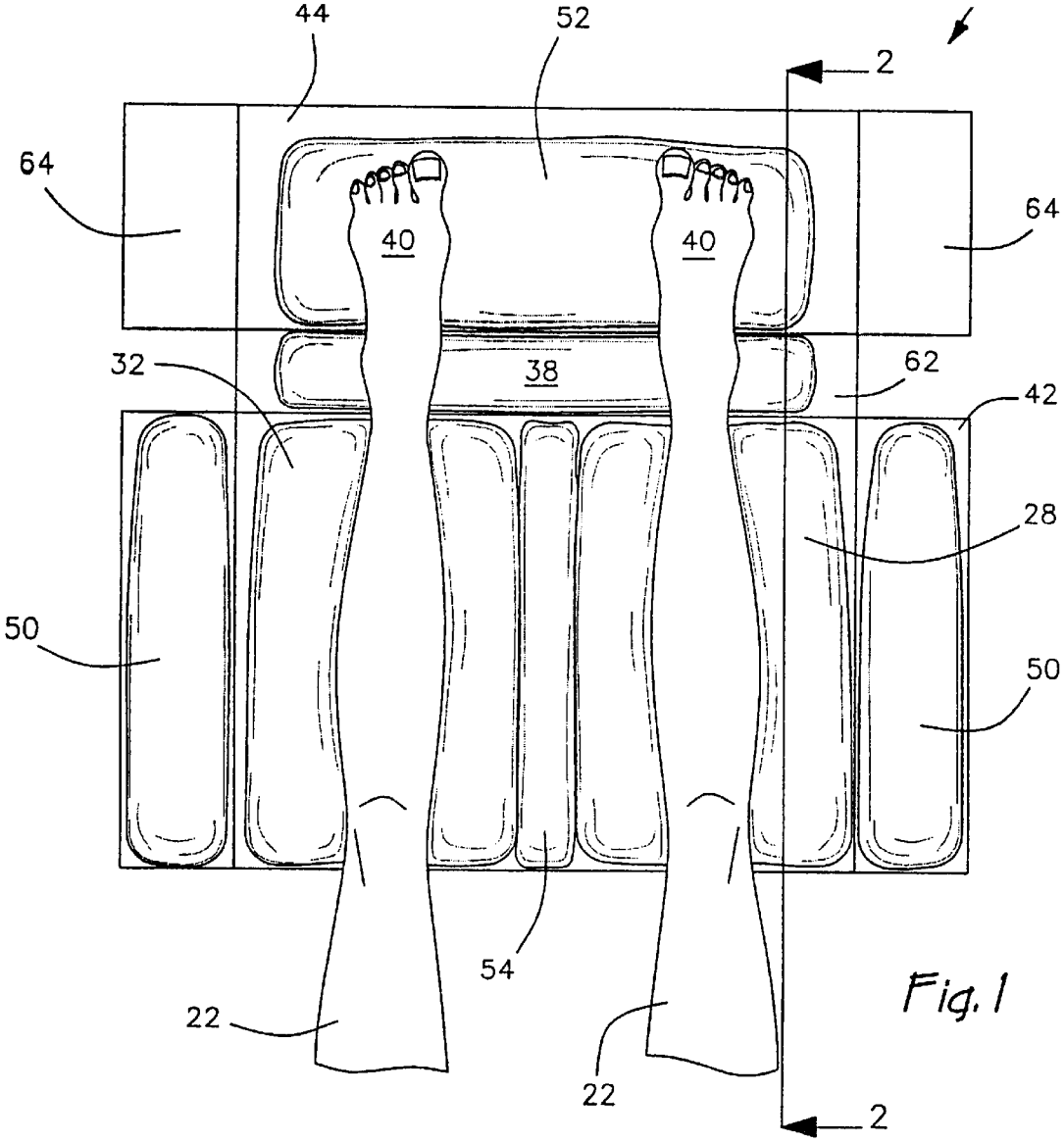
FIG. 1 is a top view of the present invention in the prevention mode.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the drawings and with specific reference to FIG. 1, the preferred embodiment of the present invention is depicted as heel supporting medical apparatus 20. As show therein it can be seen that apparatus 20 provides a mechanism by which legs 22 of an individual can be elevated and avoid contact between heels 24 and the bed mattress, and thus avoid the formation of pressure ulcers.

Figure 2:
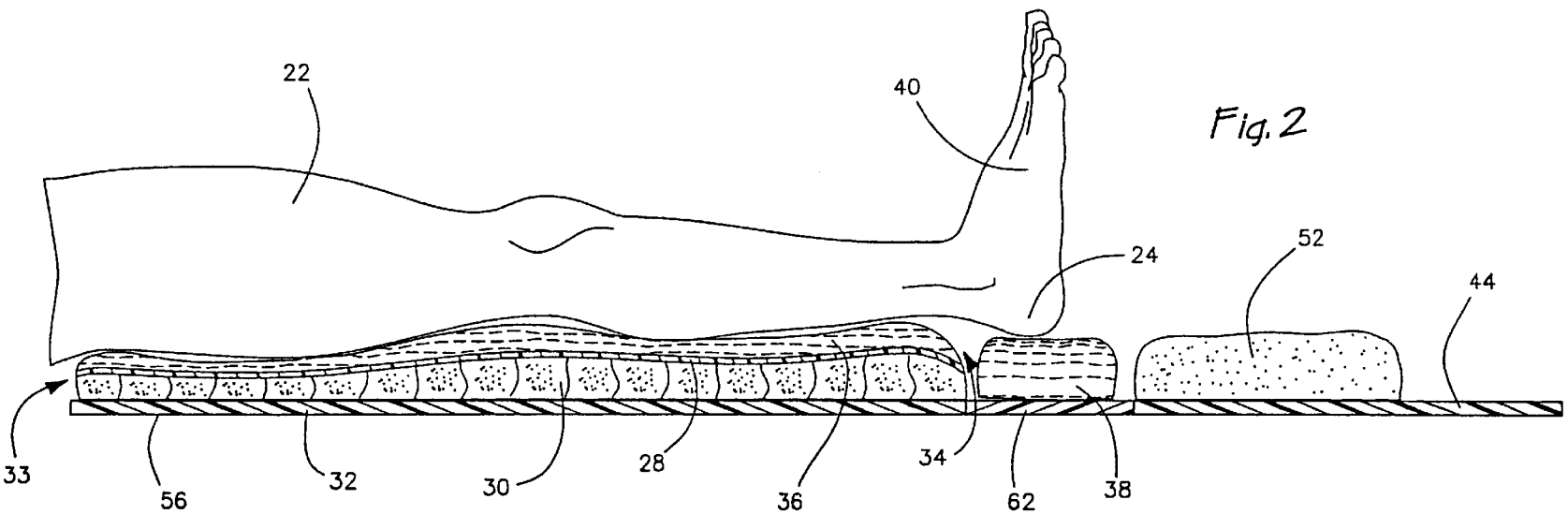
FIG. 2 is a side view of FIG. 1 taken along line 2—2.
Figure 3:
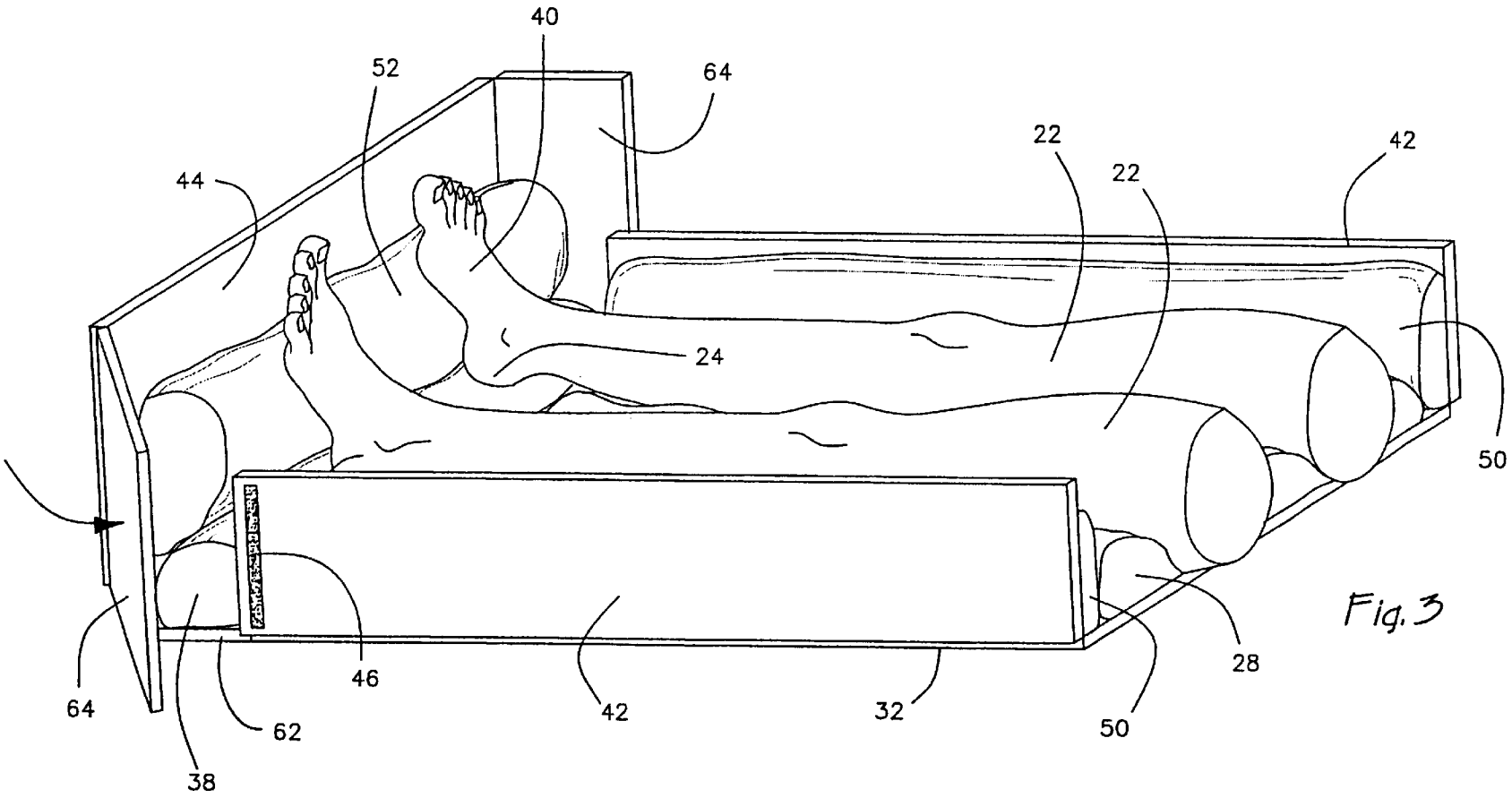
FIG. 3 is a perspective view of the present invention in a treatment mode.
Figure 4:
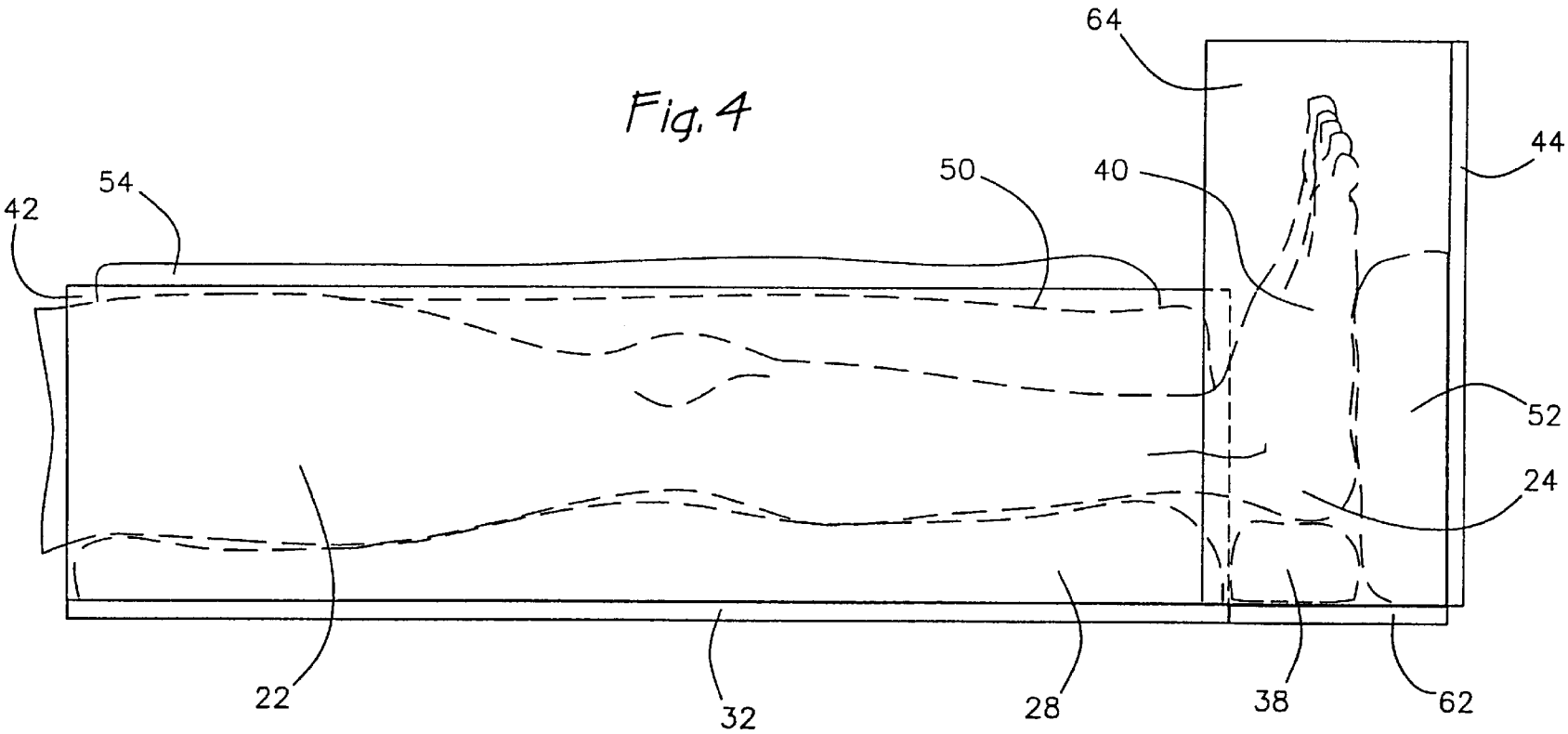
FIG. 4 is a side view of the present invention in a treatment mode.

At this point of the disclosure, it is important to understand that the preferred embodiment of the present invention is adapted to function in at least two modes: a prevention mode, depicted in FIGS. 1 and 2, and a treatment mode, depicted in FIGS. 3 and 4. The invention will be described in detail with respect to both modes starting with the prevention mode.

As shown in FIGS. 1 and 2, in the prevention mode, each leg is supported by air mattress or bladder 28 contoured to not only cushion the leg, but elevate the leg such that the ankle is higher than the rest of the leg. This is often a benefit to avoid or reduce swelling of the lower extremities. To accomplish this, it can be seen, particularly from FIG. 2, that leg air bladder 28 is provided with a plurality of internal baffles 30 which assist in maintaining the shape or contour of air bladder 28. Since each air bladder 28 is provided with an inlet adapted to exhaust air pressure or introduce air pressure either manually, or through mechanical air compressor, baffles 30 ensure that the first end 34 of bladder 28 is always higher than second end 33. Baffles 30 are preferably perforated to allow for passage of air while still maintaining contour.

The comfort of the individual can be adjusted not only by adjusting the pressure within air bladders 28, but also through the use of gel pad 36 positioned on top of air bladder 28. In the preferred embodiment of the present invention, gel pad 36 is fabricated from malleable plastic, but any suitable cushioned material can be used with similar efficacy.

It can also be seen from FIGS. 1 and 2 that directly below heel 24 of the individual, a heel pad 38 is provided. This ensures that if foot 40 of the individual is not positioned appropriately on air bladder 28, heel 24 of the individual will be supported by a cushioned surface, rather than requiring the foot to pivot and dangle, resulting in discomfort for the individual. In the preferred embodiment of the present invention, heel pad 38 is manufactured from the same material as gel pad 36.

Referring now to FIGS. 3 and 4, the treatment mode of the present invention will be discussed in detail. As alluded to earlier, it is sometimes necessary for the legs of the individual to not only be elevated, but also to be substantially immobilized. Such immobilization should limit lateral as well as rotational movement of each leg 22. It can therefore be seen from FIGS. 3 and 4 that in the treatment mode of the present invention, sides 42 of base 32, as well as bottom 44 of base 32, are folded upright to be perpendicular to center 44 of base 32. In so doing, a box like structure is formed and secured into position using suitable fasteners 46. Any number of fasteners are suitable for performing this function, with some feasible examples being tongue and loop fasteners (FIGS. 3 and 5B), eyelets and laces, as well as snaps, buttons (FIG. 5A) and zippers.

When sides 42 and bottom 44 of base 32 are folded into the perpendicular position shown in FIGS. 3 and 4, it can be seen that the air bladders attached to each folded surface come into contact with the legs 22 of the individual. More specifically, side bladders 50 are attached to each side 42, whereas foot bladder 52 is attached to bottom 44. Bladders 50 and 52 are similar to air bladder 28 in that the pressure within each can be adjusted by changing the air compression within each. In alternative embodiments, it is to be understood that each bladder need not be air supported, but could be any other type of cushioned material to provide support for legs 22.

In so doing, it can be seen by one of ordinary skill in the art, that bottom 44, in conjunction with foot bladder 52, will prevent longitudinal movement or sliding of the individual past apparatus 20 and maintain the proper position of heel 24. Similarly, sides 42 in cooperation with bladders 50, substantially limit the degree of lateral and rotational movement allowed for the individual.

A still further air bladder 54 can be added to the center of base 32 to be positioned between the legs 22 of the individual to even further the limit the degree of lateral and rotational movement of the legs, this time in an inward direction.

In the preferred embodiment of the present invention, base 32 is manufactured from a plastic material, having sufficient rigidity to support the bladders, and is provided with a surface coating 56 on its bottom to prevent or to substantially limit movement of base 32 relative to the mattress. Alternatively, base 32 can be appropriately scarred or ridged to increase surface area, and thereby increase its co-efficient of friction relative to the mattress surface.

Figure 5A:
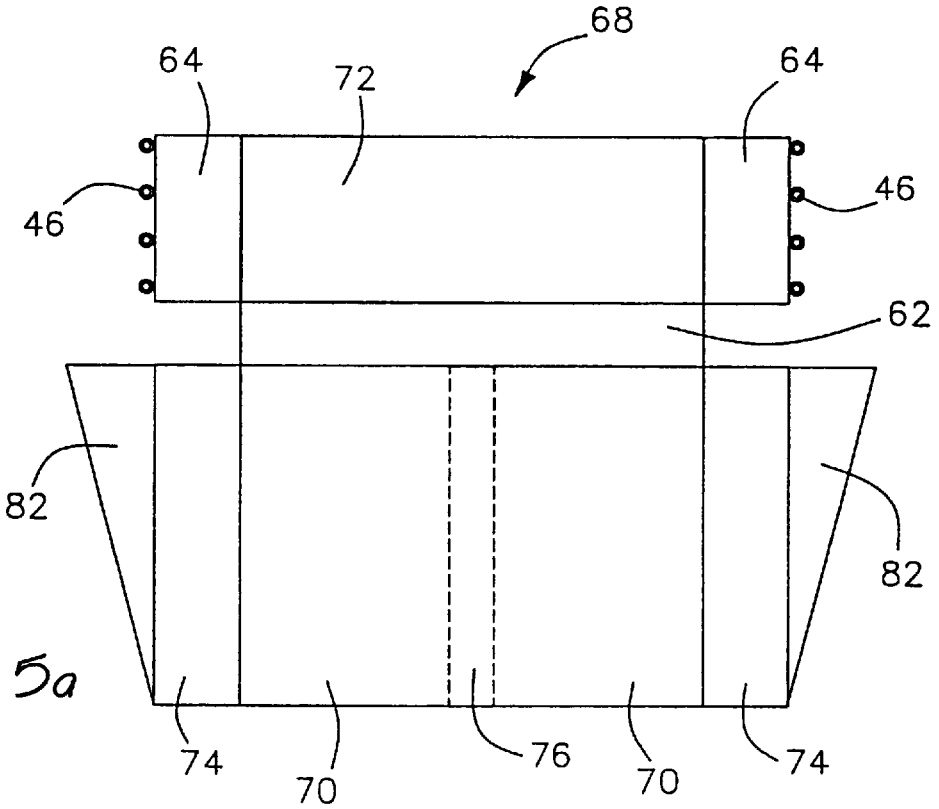
FIG. 5A is a plan view of the cover for one embodiment of the present invention.
Figure 5B:
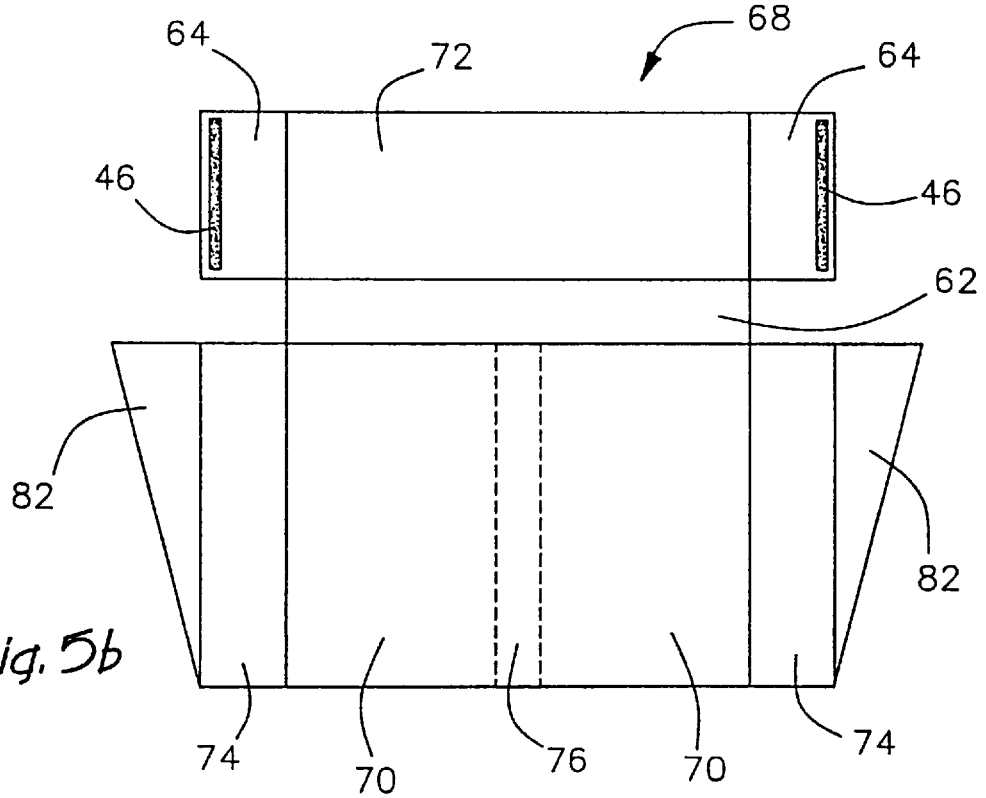
FIG. 5B is a plan view of the cover for another embodiment of the present invention.

The gel layer 36 in the preferred embodiment of the present invention is provided on top of foot bladder 52 and leg bladders 28. However, in an alternative embodiments, a similar gel layer could be provided on top of side bladders 50 as well. Within heel well 62, relatively thick heel pad 38 manufactured from the same gel like material is provided. Referring to FIGS. 5A and 5B, first and second embodiments of cover 68 are shown. Cover 68 can be provided to receive all of the aforementioned components and provide the exterior surface for device 20. Cover 68 is preferably removable to facilitate cleaning and reuse. More specifically, cover 68 is preferably manufactured from a cloth material to not only provide additional comfort for the individual, but also to facilitate such cleaning.

Cover 68 preferably includes a plurality of sleeves adapted to receive base 32, bladders 28, 50, 52, and 54, and gel pads 36 and 38. More specifically, cover 68 includes first and second leg bladder sleeves 70, foot bladder sleeve 72, first and second side bladder sleeve 74, as well as center bladder sleeve 76. Moreover, it can be seen in this embodiment that sides 42 include triangularly shaped sections 82 which provide a surface equal in length to that of flaps 64 for connection purposes, and which taper back to top 34 of base 32. Suitable plastic inserts can be positioned within the sleeves of cover 68 to accommodate flaps 64 and triangular pieces 82. FIG. 5A shows fasteners 46 in the form of buttons, while FIG. 5B shows fasteners 46 in the form of tongue and loop fasteners.

From the foregoing, it can therefore be seen that the present invention provides a new and improved heel supporting medical apparatus for the prevention and treatment of decubitus. Not only is the present invention able to elevate the legs of an individual to prevent contact between the heel of the individual and the mattress upon which the apparatus is disposed, but it does so in a manner which provides heretofore unseen comfort levels. Not only can the present invention elevate the heels of the individual, but can substantially immobilize the legs of the individual in a treatment mode to prevent longitudinal, lateral, and rotational movement of the legs of the individual.

What is claimed is:

1. A heel protection device for treating and preventing formation of pressure ulcers, the device comprising:

a base having first and second ends defining a longitudinal axis, and first and second sides defining a lateral axis;

a first support on the base and adapted to support and elevate human legs;

a second support on the base proximate the first end and spaced from the first support, the second support adapted to limit longitudinal movement of human feet;

third and fourth supports on the base proximate the first and second sides, respectively, and adapted to limit lateral and rotational movement of human legs;

a cushioned heel support on the base between the first and second supports and between the third and fourth supports, the heel support adapted to be positioned immediately below a human heel elevated by the first support;

wherein the first support is divided into two halves to support and elevate individual human legs, and wherein the device further includes a fifth support on the base between the two halves of the first support, the fifth support adapted to limit lateral and rotational movement of human legs; and wherein the first, second, third, fourth, and fifth supports are inflatable and expandable by changing air pressure within each support.

2. The heel protection device of claim 1 wherein the device is operable in a prevention mode and a treatment mode, the first support being inflated and the second, third, fourth, and fifth supports being deflated in the prevention mode, all supports being inflated in the treatment mode.

3. The heel protection device of claim 2 wherein the first end and first and second sides of the base are movable to be perpendicular to a center of the base when the device is in the treatment mode, the second support moving with the second end, the third and fourth supports moving with the first and second sides.

4. The heel protection device of claim 3 wherein the first end and first and second sides of the base include fasteners adapted to secure the second end and first and second sides together in the treatment mode.

5. A medical apparatus for elevating and substantially immobilizing the legs of an individual, the apparatus comprising:

a cushioned member adapted to support the legs from below, from both sides, and against the bottom of the foot when the individual is positioned horizontally, the heel of the individual being elevated by and not being in contact with the cushioned member;

means for changing the amount of pressure imparted by the cushioned member against the legs of the individual; and further including a heel pad positioned immediately below the heels of the individual.

6. The medical apparatus of claim 5 wherein the means for changing pressure includes air chambers within the cushioned member, the air chambers adapted to be opened for exhaustion or introduction of air pressure.

7. The medical apparatus of claim 5 wherein the cushioned member includes individual air bladders adapted to be positioned below each leg, on the outside of said leg, between the legs, and against the bottom of the feet.

* * * * *